US006907710B2

(12) United States Patent
Trundle

(10) Patent No.: US 6,907,710 B2
(45) Date of Patent: Jun. 21, 2005

(54) METHOD OF SECURING A FRAMED PANEL

(75) Inventor: Simon Trundle, Northamptonshire (GB)

(73) Assignee: FrameGard Anchoring Systems Limited, Northamptonshire (GB)

( * ) Notice: Subject to any disclaimer, the term of this patent is extended or adjusted under 35 U.S.C. 154(b) by 32 days.

(21) Appl. No.: 10/220,815

(22) PCT Filed: Mar. 8, 2001

(86) PCT No.: PCT/GB01/01019

§ 371 (c)(1),
(2), (4) Date: Nov. 12, 2002

(87) PCT Pub. No.: WO01/66898

PCT Pub. Date: Sep. 13, 2001

(65) Prior Publication Data

US 2003/0140593 A1 Jul. 31, 2003

(30) Foreign Application Priority Data

Mar. 8, 2000 (GB) ..... 0005595

(51) Int. Cl.[7] ..... E04G 23/00

(52) U.S. Cl. ..... 52/745.21; 52/173.1; 52/203; 52/476; 52/506.05; 52/489.1; 49/57

(58) Field of Search ..... 52/106, 171.1, 52/173.1, 202; 49/57, 463, 465

(56) References Cited

U.S. PATENT DOCUMENTS

| | | | | | |
|---|---|---|---|---|---|
| 2,025,161 | A | * | 12/1935 | Franklin | |
| 2,598,610 | A | * | 5/1952 | Satz et al. | |
| 2,607,088 | A | * | 8/1952 | Schoepfer | |
| 2,694,842 | A | * | 11/1954 | Scott et al. | |
| 6,263,625 | B1 | * | 7/2001 | LaPointe | 52/202 |
| 6,460,226 | B1 | * | 10/2002 | Smith et al. | 24/115 |
| 6,494,000 | B1 | * | 12/2002 | Emek | 52/202 |
| 6,497,077 | B1 | * | 12/2002 | Emek | 52/202 |

* cited by examiner

*Primary Examiner*—Carl D. Friedman
*Assistant Examiner*—Yvonne M. Horton
(74) *Attorney, Agent, or Firm*—Baker & Hostetler LLP; Sean A. Pryor

(57) ABSTRACT

A framed panel (1) consists of a panel (2) mounted in a frame (3). In order to secure the panel, a shock cord (4) is fastened across the panel (2), one or both ends of the shock cord (4) being held in a cleat (6*a*, 6*b*), so that the panel (2) is arrested when subjected to shock.

18 Claims, 1 Drawing Sheet

METHOD OF SECURING A FRAMED PANEL

FIELD OF THE INVENTION

The present invention relates to a method of securing a framed panel subjected to shock, for example, high winds and explosions, and also to a framed panel so secured.

BACKGROUND OF THE INVENTION

Framed panels made of shattering materials tend to shatter when subjected to shock and the shattered fragments of the panels may be propelled at high speeds into the room in which the framed panel is located, causing injury to personnel and/or damage to the room.

Non-shattering panels, such as panels made of laminated glass, polycarbonates or glass coated in protective film, are frequently used to prevent such injury to personnel and damage to property, and are generally effective for this purpose. However, it is not uncommon, eg during an external explosion, for the entire panel, whether made of shattering or non-shattering material, to be forced out of the frame and to travel at high speed into the room in which it is located. This is particularly problematic when the panel is held in a relatively weak frame, such as a timber frame. Such panels can travel at up to 10 m/s (approximately 30 feet per second) and can cause serious injury to personnel, as well as significant damage to property.

Attempts have been made to arrest the movement of such a panel from the surrounding frame by reinforcing the frame with steel bars. However, it has been found that such steel bars can also be forced away from the frame and driven into the room at high speed, potentially causing serious injury to personnel and damage to property.

SUMMARY OF THE INVENTION

An object of the present invention is to provide a method for securing a framed panel subjected to shock, in which the above disadvantages are overcome.

The invention provides a method of securing a framed panel a claimed in claim 1. The invention also provides a secured framed panel as claimed in claim 17.

The invention is particularly applicable to the petrochemical industry, in which explosions re relatively common. The framed panel to be secured is preferably made of a non-shattering material. In a preferred embodiment of the invention, the shock cord has a maximum elasticity of 10%.

The ends of the shock cord are preferably protected. In a preferred embodiment the ends of the shock cord are protected by heat shrinking. Alternatively, the ends of the shock cord are protected by a cap on the cleat.

The cleat is preferably attached to the frame. In a preferred embodiment, the cleat is attached to the frame by means of one or more buttress screws. In a further preferred embodiment of the invention the shock cord is held at both ends by a cleat.

The panel to be secured is preferably made of a polycarbonate material. In a preferred embodiment the panel is a window and is made of laminated glass. Alternatively, the window is made of glass covered by window film. The shock cord is preferably a polyester braided rope. In a further preferred embodiment, two or more shock cords are arranged across the panel.

Embodiments of the invention will now be described with reference to the accompanying drawings, in which:

DESCRIPTION OF THE PREFERRED EMBODIMENT

Figure 1:
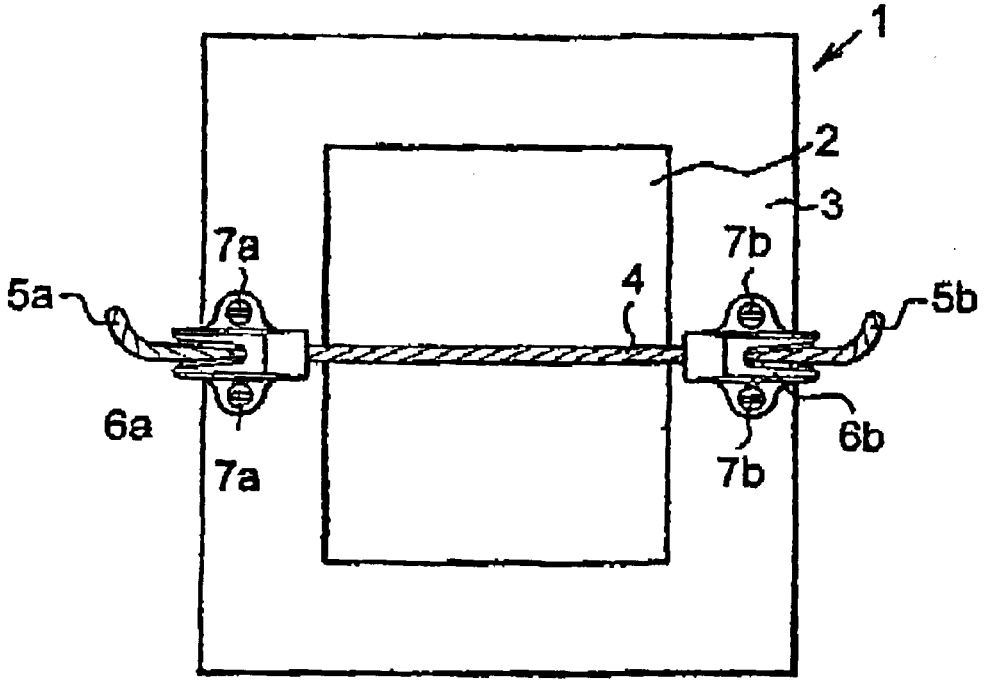
FIG. 1 is a front view of a framed panel secured in accordance with the invention.

In FIG. 1 a secured framed panel 1 has a non-shattering panel 2 mounted in a frame 3. The term "non-shattering" refers to a material which does not shatter when subjected to shock, but also includes materials which do shatter but are provided with means for holding the shattered pieces together, such as window film, so that the shattered pieces remain joined together in such a way that the shattered panel retains substantially the same shape as in the unshattered state.

A flexible shock cord 4 is arranged across the framed panel 1, at such a height on the framed panel as to adequately support the framed panel 1. The ends 5*a* and 5*b* of the shock cord 4 are located in cleats 6*a* and 6*b*, respectively, attached to the frame 3. Alternatively, the cleats 6*a* and 6*b* may be attached to the wall in which the framed panel is mounted. The cleats 6*a* and 6*b* are attached by means of buttress screws 7*a* and 7*b*, respectively. Butress screws have a relatively high pull-out pressure and are thus well-suited for this application, in which the loads to which the framed panels are subjected are relatively high. However, it is posible to attach the cleats by means of other screws.

Figure 2:
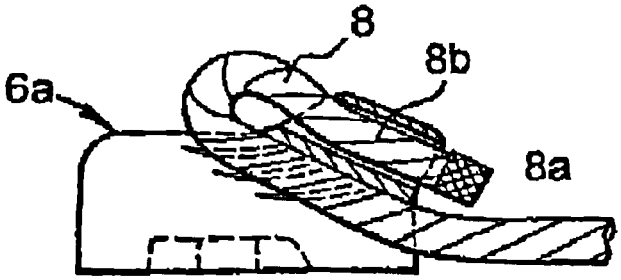
FIG. 2 is a side view of one end of a shock cord held in a cleat.
Figure 3:
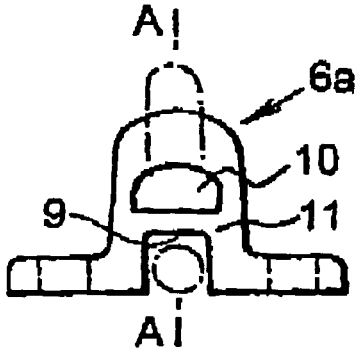
FIG. 3 is an end view of the cleat of FIG. 2.
Figure 4:
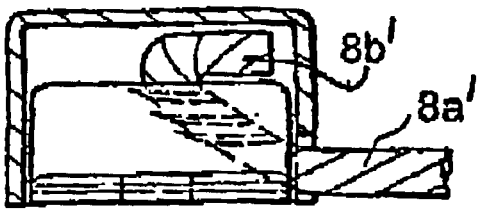
FIG. 4 is a side view of one end of a shock cord held in an alternative cleat with a cover.
Figure 5:
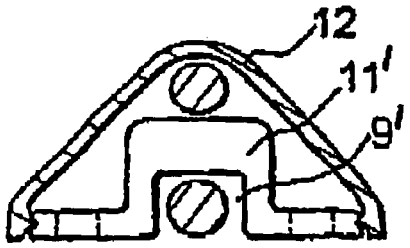
FIG. 5 is an end view of the shock cord and cleat of FIG. 4.

FIGS. 2 and 3 show the arrangement of the end 5*a* of the shock cord 4 in the cleat 6*a* in detail. It will be appreciated that the arrangement of the end 5*b* in clean 6*b* will be similar. The end 5*a* of the shock cord 4 is arranged as a loop 8 having opposing sides 8*a* and 8*b*. The side 8*a* of the loop 8 is arranged in a recess 9 in the cleat 6*a* and the opposing side 8*b* is arranged in a channel 10 in the cleat 6*a*. The channel 10 is arranged above the recess 9 and is substantially parallel thereto. The recess 9 and channel 10 are located on the central vertical plane A—A of the cleat 6*a* and are separated by a dividing portion 11. The end 5*a* of the shock cord 4 has been treated by heat shrinking to prevent unravelling of the cord 4. FIGS. 4 and 5 show the arrangement of the end 5*a* of the shock cord 4 in an alternative cleat $6a^1$. Again, the end 5*a* of the shock cord is arranged as a loop $8^1$ having opposing sides $8a^1$ and $8b^1$. The side $8a^1$ is arranged in a recess $9^1$ and the opposing side $8b^1$ is arranged above a dividing portion $11^1$. A cap 12 is arranged around the cleat $6a^1$ and the side $8b^1$, so that the end of the shock cord 4 is completely covered to protect the end of the shock cord.

When the framed panel 1 is subjected to shock, such as a gust of strong wind or an explosion, the panel 2 starts to move away from the frame 3. The shock cord arrests the movement of the panel 2 and prevents it from travelling at high speed into the interior of the room, in which it is located. Although, in extreme cases, the panel 2 may fall into the interior of the room, it is likely to fall close to the frame 3 and not travel across the room. The shock cord 4 also stretches and absorbs a significant portion of the energy of the explosion or gust of wind, thus reducing the load on the frame 2. In the event that the shock cord 4 is forced out of the cleats 6*a* and 6*b*, the damage caused by the shock cord will be minimal in comparison to the damage that would be caused if a steel bar were to be used.

A number of different cleats can be used to hold the shock cord 4 but the "CL255 Omega" cleat manufactured by Clamcleats Limited of Watchmead, Welwyn Garden City, Hertfordshire, AL7 1AP, England, and coverd by UK Pat. No. 2 299 366 is particularly suitable. This type of cleat wedges the shock cord 4 in a groove. However, alternative types of cleat, such as T-shaped cleats, in which the shock cord 4 is wound around the cleat would also be suitable. The shock cord 4 is a braided polyester/nylon interlayer with a woven polyester shield. However, any other suitable shock cord, such as an elasticated rubber (bungee) shock cord, may be used. Suitable shock cords generally have a maximum elasticity of 10%. However, it has been found that shock cords having higher elasticity can still be effective, provided that the pressures applied to the system are relatively low.

In the embodiments described above each end of the shock cord 4 is held in a cleat. However, it is possible for only one end of the shock cord 4 to be held in a cleat, the other end being held by another device, for example, a clamp. Similarly, while two buttress screws are used to hold each cleat in the present embodiment, it would be possible to secure a cleat of suitable design using one screw only.

In the embodiments described above, one shock cord is arranged horizontally across the framed panel. In taller framed panels, it may, however, be necessary to use several shock cords, arranged one above the other. Alternatively, a shock cord can be arranged either vertically or diagonally across the framed panel.

The method can be applied to existing framed panels relatively quickly and inexpensively, particularly in comparison with steel bars.

What is claimed is:

1. A method of securing a framed panel including a panel mounted in a frame, the method comprising fastening at least one shock cord across the panel, and holding an end portion of the shock cord in a cleat having a groove wherein the end portion of the shock cord is wedged, so that the panel is arrested by the at least one shock cord when subjected to shock wherein the cleat further comprises at least two openings sized to loop and wedge the shock cord therein.

2. A method as claimed in claim 1, wherein the panel is made of non-shattering material.

3. A method as claimed in claim 2, wherein the shock cord has a maximum elasticity of 10%.

4. A method as claimed in claim 1, wherein the extremity of said end portion is protected.

5. A method as claimed in claim 4, wherein the extremity of said end portion is protected by heat shrinking.

6. A method as claimed in claim 4, wherein the extremity of said end portion is protected by a cap on the cleat.

7. A method as claimed in claim 1, wherein the cleat is attached to the frame.

8. A method as claimed in claim 7, wherein the cleat is attached to the frame by means of one or more buttress screws.

9. A method as claimed in claim 1, wherein the shock cord is held at both ends by a said cleat.

10. A method as claimed in claim 1, wherein the panel is made of a polycarbonate material.

11. A method as claimed in claim 1, wherein the panel is a window.

12. A method as claimed in claim 11, wherein the panel is made of laminated glass.

13. A method as claimed in claim 11, wherein the panel is made of glass covered by window film.

14. A method as claimed in claim 1, wherein the shock cord is a polyester braided rope.

15. A method as claimed in claim 1, wherein two or more said shock cords are arranged across the panel and held in respective cleats.

16. A framed panel secured by a method as claimed in claim 1.

17. A method as claimed in claim 1, wherein the shock cord has a maximum elasticity of 10%.

18. A method of securing a framed panel including a panel mounted in a frame which is mounted in a wall, the method comprising:

attaching at least one cleat to the frame or the wall, the cleat having a groove;

fastening at least on shock cord across the panel; and wedging an end portion of the shock cord in the groove and thereby holding the end portion in the cleat, so that the panel is arrested by the at least one shock cord when subjected to shock, wherein the cleat further comprises at least two openings sized to loop and wedge the shock cord therein.

* * * * *

UNITED STATES PATENT AND TRADEMARK OFFICE

CERTIFICATE OF CORRECTION

PATENT NO. : 6,907,710 B2
DATED : June 21, 2005
INVENTOR(S) : Simon Trundle

It is certified that error appears in the above-identified patent and that said Letters Patent is hereby corrected as shown below:

Column 4,
Line 38, please replace "on" with -- one --.

Signed and Sealed this

Sixteenth Day of August, 2005

JON W. DUDAS
*Director of the United States Patent and Trademark Office*